US005661898A

United States Patent [19]

Matsuzawa

[11] Patent Number: 5,661,898

[45] Date of Patent: Sep. 2, 1997

[54] TERMINAL CRIMPING APPARATUS WITH

[75] Inventor: Susumu Matsuzawa, Iwate-ken, Japan

[73] Assignee: Sumitomo Wiring Systems, Ltd., Japan

[21] Appl. No.: 572,511

[22] Filed: Dec. 14, 1995

[30] Foreign Application Priority Data

| | | | |
|---|---|---|---|
| Dec. 15, 1994 | [JP] | Japan | 6-312128 |
| Nov. 21, 1995 | [JP] | Japan | 7-303101 |
| Nov. 21, 1995 | [JP] | Japan | 7-303102 |

[51] Int. Cl.[6] ..... H01R 43/048; H01R 43/28

[52] U.S. Cl. ..... 29/753; 29/33 M; 29/760; 29/863

[58] Field of Search ..... 29/33 M, 753, 29/759, 760, 863; 72/712

[56] References Cited

U.S. PATENT DOCUMENTS

| | | | |
|---|---|---|---|
| 3,869,781 | 3/1975 | Eubanks et al. | 29/33 M X |
| 4,575,931 | 3/1986 | Jonca | 29/747 |
| 4,852,241 | 8/1989 | Belaidouni et al. | 29/753 X |
| 4,901,434 | 2/1990 | Sato et al. | 29/753 |
| 4,979,291 | 12/1990 | Phillips et al. | 29/863 |
| 5,074,033 | 12/1991 | Dassance et al. | 29/753 |
| 5,084,960 | 2/1992 | Yeomans | 29/753 |
| 5,197,171 | 3/1993 | Hatfield | 29/33 M |
| 5,432,992 | 7/1995 | Takenami et al. | 29/33 M X |
| 5,491,887 | 2/1996 | Quinn | 29/753 |

FOREIGN PATENT DOCUMENTS

| | | | |
|---|---|---|---|
| 139368 | 5/1985 | European Pat. Off. | 29/753 |
| 1298076 | 5/1962 | France | 29/753 |
| 1189883 | 7/1989 | Japan | 29/753 |
| 6-231856 | of 1994 | Japan . | |
| 6140121 | 5/1994 | Japan | 29/753 |
| 6-88093 | 12/1994 | Japan | 29/753 |

*Primary Examiner*—Peter Vo

*Attorney, Agent, or Firm*—Anthony J. Casella; Gerald E. Hespos

[57] ABSTRACT

A wire position correcting device is used with a terminal mounting apparatus A for mounting a terminal fitting on a wire E fed between a crimper 32 and an anvil 20 from a side. A rotatable member 60 is provided which rotates as the crimper 32 moves upward and downward. The rotatable member 60 rotates when the wire E is fed and presses a specified position of the wire E to correct the position of the wire E so that the terminal fitting can be properly mounted at an end of the wire E. Accordingly, the end of the wire E can be accurately placed right on the fed terminal fitting during a terminal mounting operation. Even if the wire E is curved or deformed while being fed, the terminal mounting operation can be constantly properly performed. The mount position of a wire holding member 50 needs not be finely adjusted.

15 Claims, 11 Drawing Sheets

TERMINAL CRIMPING APPARATUS WITH

BACKGROUND OF THE INVENTION

1. Field of the Invention

The present invention relates to wire processing apparatus, in particular to a wire position correcting device for use with a wire processing apparatus e.g. for mounting a terminal fitting at an end of the wire by pressing the terminal fitting and the wire with a lower mold and an upper mold which is moved upward and downward with respect to the lower mold.

2. Description of the Prior Art

A terminal mounting apparatus is known which feeds a series of terminal fittings connected as in a chain while successively cutting them, feeds a wire having an exposed end on the fed terminal fitting, and mounts the terminal fitting at the exposed end of the wire using upper and lower molds.

FIG. 7 is a perspective view of an essential portion of a prior art terminal mounting apparatus. With reference to FIG. 7, the terminal mounting apparatus A includes a crimper 1*a* at the bottom, a shank 1, an anvil 2, a terminal feeding mechanism 3, a rotatable arm (not shown) and a wire holding member 5. The shank 1 is coupled with a press ram (not shown) so as to move upward and downward (directions indicated by wide arrows) together with the press ram. The anvil 2 is provided below the crimper 1*a*. The terminal feeding mechanism 3 feeds terminal fittings (not shown) to the anvil 2. The rotatable arm conveys a wire 4 to a position between the crimper 1*a* and the anvil 2 in a direction indicated by a thin arrow. The wire holding member 5 receives and holds a portion 4*b* of the wire 4 near an exposed end 4*a* (having an insulating sheath peeled off).

The wire 4 having conveyed by the rotatable arm and held by the wire holding member 5 is in such a position where the terminal fitting can be mounted at its exposed end. Subsequently, the shank 1 is moved downward, with the result that the fed wire 4 and the terminal fitting are pressed by the crimper 1*a* and the anvil 2 and the terminal fitting is mounted at the end of the wire 4.

In order to perform the above pressing, the end 4*a* of the wire 4 needs to be conveyed right on the fed terminal fitting and held so as not to be displaced. This is because, if pressing is applied when the end 4*a* is not positioned right on the terminal fitting, a core of the wire may come out of the terminal fitting or the terminal fitting may be improperly deformed. This causes an improper mounting of the terminal fitting. In order to avoid this problem, the wire holding member 5 is formed with a recess 5*a* in which the portion 4*b* near the end 4*a* of the conveyed wire 4 is fitted. The portion 4*b* of the wire 4 conveyed by the rotatable arm can be positioned right on the terminal fitting by being fitted in the recess 5*a* after moving over a projected portion 5*b* of the wire retainer 5.

The portion 4*b* of the wire 4 is not vigorously moved to the recess 5*a* to be fitted therein, but is fitted in the recess 5*a* as a result that the wire 4 is conveyed by the rotatable arm. More specifically, the wire 4 is conveyed while having its portion away from the portion 4*b* by a specified distance gripped by the rotatable arm. During this conveyance, the portion 4*b* moves over the projected portion 5*b* of the wire holding member 5 and is fitted in the recess 5*a*.

The above causes the following inconveniences.

(1) The wire 4 may be curved or deformed while being conveyed by the rotatable arm since the portion 4*b* of the wire 4 is away from the portion thereof gripped by the rotatable arm by the specified distance. In such a case, the portion 4*b* cannot be fitted in the recess 5*a*.

(2) A mounting position of the wire holding member 5 needs to be finely adjusted in order to satisfactorily fit the portion 4*b* in the recess 5*a*. This fine adjustment requires a skill.

Because of these inconveniences, it is difficult with the prior art wire holding member 5 constantly to hold the portion 4*b* of the wire 4 right on the terminal fitting when the pressing operation is continuously performed.

It is thus an object of the present invention to provide an improved wire processing apparatus, in particular for terminal mounting on a wire, which allows a better, in particular more precise processing of the wire.

SUMMARY OF THE INVENTION

The invention is directed to a wire processing apparatus for mounting a terminal on a wire. According to a first aspect, the apparatus comprises a lower means, an upper means movable upward and downward with respect to each other, wire feeding means conveying an end of a wire between the upper means and the lower means, wire positioning means for receiving a portion of the wire near its end, in particular while the wire feeding means is in its wire feeding position, and positioning, in particular holding the wire in such a position that a wire processing can be applied at the end of the wire, and a wire position correcting device comprising: wire position correcting means which is movable for guiding the portion of the wire near its end so that this portion can be positioned by the wire positioning means, and a gearing mechanism for temporarily translating a movement of the upper means into a movement of the wire position correcting means.

According to a preferred embodiment, the wire position correcting means comprises a rotatable member having one end rotatably supported preferably on a main body and another end formed with a guiding portion for guiding, preferably by pressing the wire.

According to a further preferred embodiment, the gearing mechanism comprises a movement translating mechanism for translating a linear movement of the upper means into a rotational movement of the rotatable member, wherein the gearing mechanism comprises preferably an intermediate member being interposed between the upper means and the rotatable member.

According to a further preferred embodiment, the rotatable member is coupled to the intermediate member by means of constraining means for temporarily rotating the rotatable member integrally with the intermediate member, wherein the constraining means comprises preferably frictional resistance applying means for applying a frictional resistance between the rotatable member and the intermediate member.

According to a preferred arrangement, the intermediate member is coupled with the upper means with a specified backlash, wherein the intermediate member comprises preferably first and second intermediate member parts arranged such that they form a clearance there between in an interaction direction for providing the specified backlash.

According to a further embodiment of the invention, the apparatus further comprises: first positioning means provided for coming into contact with the wire position correcting means, in particular the rotatable member in rotation or a member integrally rotating with the rotatable member, at a specified timing, preferably before the upper means reaches its bottom end position, thereby holding the wire position correcting means, in particular the rotatable member in a first position, and a second positioning means provided for coming into contact with the wire position correcting means, in particular with the rotatable member in rotation or the member integrally rotating with the rotatable member, at another specified timing, preferably before the upper means reaches its top end position, thereby holding the wire position correcting means, in particular rotatable member in a second position.

According to a further preferred embodiment, the wire positioning means comprises a wire material and a guide portion extending obliquely upward for guiding a portion of the wire.

In particular, according to a second aspect, when applied to a wire processing apparatus for terminal mounting, the present invention provides a wire position correcting device for correcting a position of a wire so that an end of the wire can be constantly positioned, in particular held in a proper position with respect to a terminal fitting when pressing is applied.

(1) In particular, a wire position correcting device is applied to a terminal mounting apparatus comprising a main body; a lower mold secured on the main body; an upper mold supported on the main body, movably upward and downward with respect to the lower mold; wire feeding means which is shifted to its wire feeding position while gripping a wire in a position away from an exposed end of the wire by a specified distance, thereby placing the end of the wire between the upper and the lower molds from their lateral side; and wire holding means for receiving a portion of the wire near its end while the wire feeding means is in its wire feeding position and holding the wire in such a position that a terminal fitting fed on the lower mold can be properly mounted at the end of the wire. The wire position correcting device comprises wire position correcting means which is movable between a first position and a second position and, upon being shifted from the second position to the first position while the wire feeding means is shifted to its wire feeding position, presses the portion of the wire near its end so that this portion can be held by the wire holding means; and a gearing mechanism for shifting the wire position correcting means between its first and second positions as the upper mold moves upward and downward, respectively.

With this construction, the wire feeding means gripping the portion of the wire away from the end of the wire by the specified distance is shifted to its wire feeding position, thereby feeding the end of the wire between the upper and the lower molds. On the other hand, while the wire position correcting means is shifted to its first position as the upper mold moves downward, it presses the portion of the wire near its end so that the wire holding means can securely hold this portion. As a result, the end of the wire can be properly positioned on the terminal fitting fed on the lower mold where the terminal fitting can be accurately mounted at the end of the wire.

As the upper mold moves upward after the terminal fitting is mounted, the wire position correcting means is shifted from its first position to its second position. This allows a next wire at an end of which a terminal fitting is mounted to be fed between the upper and the lower molds, thereby enabling a continuous terminal mounting operation.

Accordingly, when the terminal fitting is mounted on the wire, the wire position correcting means having shifted to its specified position according to the downward movement of the upper mold by the gearing mechanism corrects the position of the wire by pressing the portion of the wire near its end, thereby forcibly causing the wire holding means to hold the portion of the wire near its end. Accordingly, even if the wire is curved or deformed while being fed, the end of the wire can be constantly held in a proper position with respect to the terminal fitting fed on the lower mold. This also advantageously obviates the need to finely adjust the mount position of the wire holding means.

(2) Furthermore in a wire position correcting device, the wire position correcting means comprises preferably a rotatable member having one end rotatably supported on the main body and another end formed with a pressing portion for pressing the wire, and that the gearing mechanism comprises a movement translating mechanism for translating a linear movement of the upper mold into a rotational movement of the rotatable member.

This construction performs the same operation as according to the second aspect of the invention. Particularly, when the upper mold moves downward, its downward movement, i.e. its linear movement is translated into a rotational movement of the rotatable member by the movement translating mechanism. While the rotatable member rotates, the pressing portion formed at the rotatable member presses the portion of the wire near its end to correct the position of the wire. Accordingly, the wire position correcting device is suitable for use with an applicator of the type which has upper and lower molds detachably secured on a ram of the terminal mounting apparatus. This is because the applicator receives an input, i.e. a linear movement from the ram and this input can be made use of.

Particularly, the linear movement of the upper mold is translated into the rotational movement of the rotatable member by the movement translating mechanism, and the pressing portion of the rotatable member in rotation presses the portion of the wire near its end to correct the position of the wire. Since the position of the wire is corrected by means of a simple construction for translating the linear movement of the upper mold into the rotational movement of the rotatable member, the wire position correcting device can be easily manufactured.

(3) Preferably, the wire position correcting further comprises first positioning means provided at the main body for coming into contact with the rotatable member in rotation or a member integrally rotating with the rotatable member at a specified timing before the upper mold reaches its bottom end position, thereby holding the rotatable member in its first position; and second positioning means provided at the main body for coming into contact with the rotatable member in rotation or the member integrally rotating with the rotatable member at a specified timing before the upper mold reaches its top end position, thereby holding the rotatable member in its second position. Further, the gearing mechanism comprises an intermediate member which is coupled with the rotatable member, rotatably with respect thereto, and is rotated by way of the movement translating mechanism; and constraining or restricting means for constraining or restricting the rotation of the rotatable member with respect to the intermediate member with a specified constraining or restricting force.

This construction performs the same operation as according to the second aspect of the invention.

In the case where the up-and-down movement of the upper mold is liked with the movement of the rotatable member, the opposite ends of a rotatable range of the rotatable member can be easily determined if they correspond to the bottom end position and the top end position of a movable range of the upper mold. However, in reality, the position of the wire needs to be corrected before the terminal fitting is mounted. This presents difficult requirements that the rotatable member is shifted to its position correcting position before the upper mold reaches its bottom end position and is held in that position despite the further downward movement of the upper mold.

In view of such requirements, according to the invention, the rotatable member comes into contact with the first positioning means at the specified timing before the upper mold reaches its bottom end position. Thereafter, the upper mold moves further downward to mount the terminal fitting. However, the rotatable member rotates with respect to the intermediate member which rotates as the upper mold moves downward, with the result that the rotatable member is held in its first position where it corrects the position of the wire.

The rotation of the rotatable member with respect to the intermediate member shifts the phase of the movements of the upper mold and the rotatable member. If this phase shift is left unadjusted, the rotatable member may not be able to come into contact with the first positioning means at the specified timing during a next downward movement of the upper mold. In view of this, according to the invention, the rotatable member comes into contact with the second positioning means at the specified timing before the upper mold reaches its top end position. Thereafter, the upper mold moves further upward, thereby correcting the phase shift of the movements of the upper mold and the rotatable member.

Particularly, when the movement of the upper mold is linked with the movement of the rotatable member, their movements are timed by means of the rotation of the rotatable member with respect to the intermediate member which rotates as the upper mold moves after the rotatable member is positioned. Accordingly, the movements of the upper mold and the rotatable member can be timed by a simple construction. Further, the rotatable member is held in its first position before the upper mold reaches its bottom end position so that the wire holding means can securely hold the portion of the wire near its end. Since the upper mold moves down to its bottom end position after the end of the wire is securely held in a proper position with respect to the terminal fitting, an error in the terminal fitting mounting operation can be effectively prevented.

On the other hand, if the rotatable member is held in its first position before the upper mold reaches its bottom end position, the phase of the rotatable member with respect to the intermediate member which rotates as the upper mold moves downward shifts. Before the upper molds reaches its top end position, the rotatable member is held in its second position by the second positioning means, with the result that only the upper mold moves upward while the rotatable member remains stationary. Accordingly, the shifted phase returns to the initial phase. When the upper mold having reached its top end position moves downward again, the rotatable member can be securely held in its first position. As a result, a satisfactory mounting operation can be continuously performed.

(4) Preferably, the restricting means comprises frictional resistance applying means for applying a frictional resistance to the rotatable member in the wire position correcting device.

This construction performs the same operation as according to the second aspect of the invention. Particularly, the specified restricting force is produced from the frictional force rendered from the frictional resistance applying means. Specifically, the frictional force restricts the rotation of the rotatable member with respect to the intermediate member, with the result that the intermediate member and the rotatable member rotate together. Accordingly, when the rotatable member is held in its first or second position while it is rotating, a force acts which tries to further rotate the intermediate member as the upper mold linearly moves. If this rotational force becomes larger than the frictional force, the intermediate member rotates with respect to the rotatable member.

Accordingly, since the rotation of the rotatable member is restricted by the frictional force rendered from the frictional resistance applying means, a force which acts to restrict the rotation of the rotatable member can be easily obtained.

These and other objects, features and advantages of the present invention will become more apparent upon a reading of the following detailed description and accompanying drawings.

DETAILED DESCRIPTION OF THE PREFERRED EMBODIMENT

Figure 1:
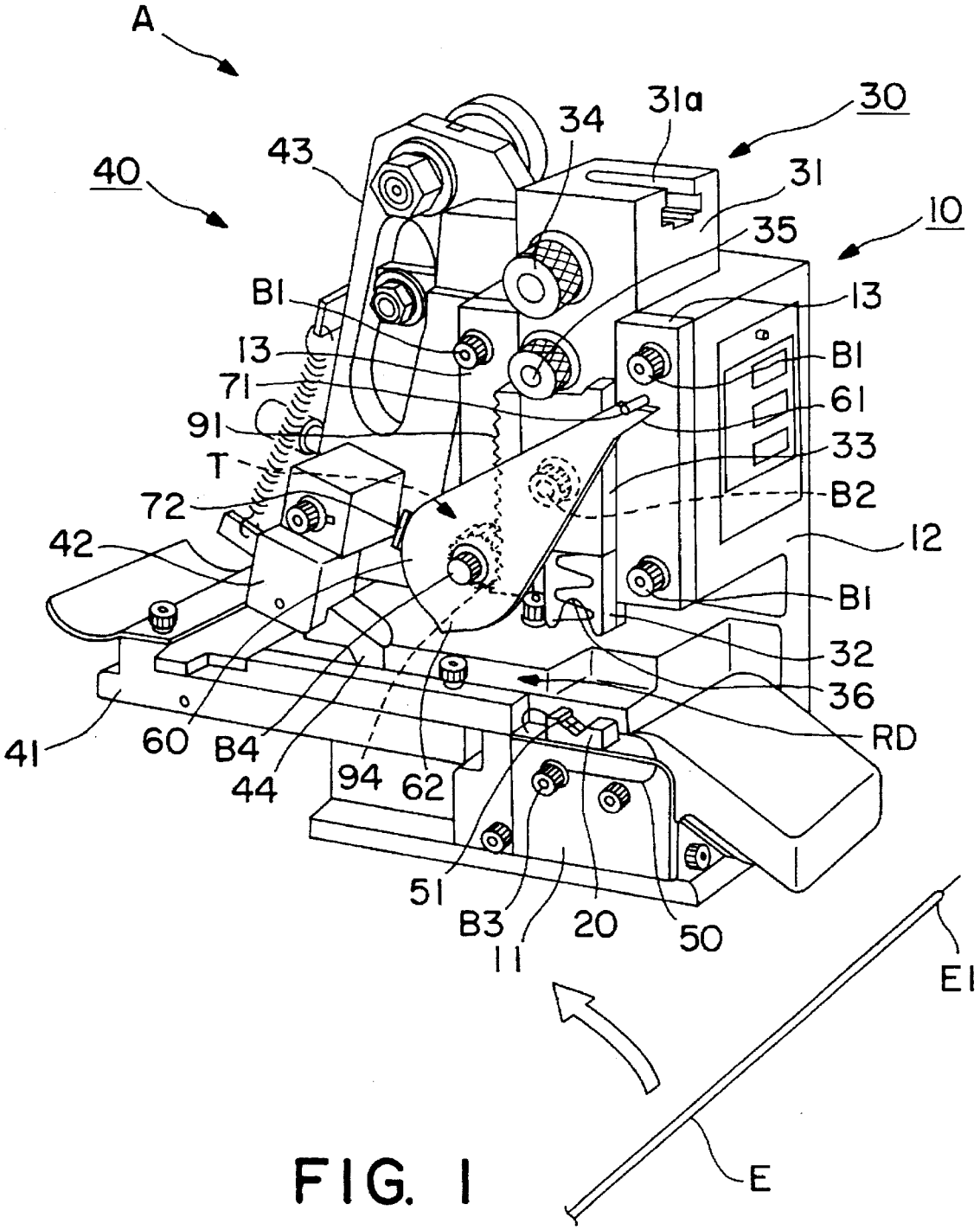
FIG. 1 is a perspective view partially showing a terminal mounting apparatus as one embodiment of the invention.

FIG. 1 is a perspective view of an essential portion of an applicator which is a part of a terminal mounting apparatus provided with a wire position correcting device according to one embodiment of the invention.

With reference to FIG. 1, the construction of the terminal mounting apparatus is schematically described. The terminal mounting apparatus includes: (1) the applicator A for pressing a terminal fitting (not shown) and an exposed end of a wire E after positioning them, (2) an unillustrated press ram for causing a shank 30 of the applicator A to make a linear up-and-down movement, (3) an unillustrated wire feeding arm for feeding the wire E to the applicator A along a direction indicated by a wide arrow, and (4) a wire retainer 50 for receiving a portion E1 near the exposed end (having an insulating sheath peeled off) of the wire E when the wire E is fed.

The applicator A includes a main body 10, an anvil 20 as a lower mold secured on a bed 11 which is an integral part of the main body 10, the shank 30 which is movably supported upward and downward on the main body 10 and is caused to move upward and downward with respect to the anvil 20 by the press ram, and a terminal feeder 40 for cutting a series of terminal fittings connected as in a chain while feeding them from a lateral side (from the left side in FIG. 1) by means of a carrier, and feeding the cut terminal fitting onto the anvil 20. The applicator A securely mounts the terminal fitting fed on the anvil 20 on the wire E by pressing them between the anvil 20 and the shank 30.

The main body 10 includes the bed 11, a guide block 12 standing on the bed 11, and guide plates 13 secured on the guide block 12 with bolts B1. The guide block 12 is formed with a through groove extending in the vertical direction and therefore has a substantially U-shaped horizontal cross section. The guide plates 13 are flat and are mounted at the opposite sides of the groove of the guide block 12. The shank 30 is slidably fitted in a space defined by the inner surfaces of the groove of the guide block 12 and the guide plates 13.

The shank 30 includes a base 31 substantially in the form of a rectangular parallelepiped, a crimper 32 as an upper mold, and a holding plate 33 for mounting the crimper 32 on the base 31. An engagement recess 31*a* is formed at the upper end of the base 31. The engagement recess 31*a* is engaged with the press ram, and accordingly the base 31 is moved upward and downward. The holding plate 33 is secured on the base 31 with a screw B2. Accordingly, the crimper 32 is secured on the lower end of the base 31. Identified by 34 is a crimp height adjustment dial for adjusting a crimp height or height to which the crimping has to be performed or is performed. Identified by 35 is an insulation height adjustment dial for adjusting a height or thickness of the insulation. By turning the adjustment dials 34 and 35, the crimp height and the insulation height can be adjusted when the terminal fitting is mounted at the end of the wire.

The anvil 20 is secured on the bed 11 and presses the wire E and the terminal fitting in cooperation with the crimper 32. Identified by 36 is a spring. The spring 36 acts to press the wire E into a barrel of the terminal fitting before pressing, and acts to separate the terminal fitting from the crimper 32 after pressing.

The wire feeding arm is shiftable between a wire gripping position where it grips the wire E to be fed and a wire feeding position where it feeds the gripped wire E between the crimper 32 and the anvil 20. The wire feeding arm grips a portion of the wire E away from a portion E1 thereof near the end by a specified distance. In the wire feeding position, the wire feeding arm feeds the gripped wire E between the crimper 32 and the anvil 20 from the side (from the right side in FIG. 1).

The terminal feeder 40 includes a base 41 which forms a feeding path RD along which the terminal fittings are fed, a feed block 42 for feeding each terminal fitting on the anvil 20, and an adjustment block 43 for adjusting the feed block 42. The feed block 42 is provided with a feed claw 44 which successively feeds the terminal fittings at a specified pitch.

The movement of the feed claw 44 is linked with the shifting of the position of the wire feeding arm. More specifically, when the terminal fitting is fed on the anvil 20 by the feed claw 44, the wire feeding arm feeds the wire E on the fed terminal fitting.

The wire holding member 50 holds the portion E1 near the end of the wire E so that the terminal fitting fed on the anvil 20 can be mounted on the end of the wire E. The wire holding member 50 is formed, for example, by curving a music wire and is mounted on the bed 11 with a bolt B3. The wire holding member 50 is formed with a recess 51 in which the fed wire E can be fitted in. The portion E1 of the wire E near its end is fitted in the recess 51 after moving over a projected portion 52 of the wire holding member 50. In this way, the end of the wire E is positioned and held right on the fed terminal fitting.

The applicator A is provided with:

(1) a wire guiding or pressing member 60 which is rotatable about a specified axis and is adapted to guide or press the wire during its rotation while the wire E is fed between the crimper 32 and the anvil 20, thereby correcting the position of the wire, (2) a gearing mechanism T which causes the wire pressing member 60 to rotate as the crimper 32 moves upward and downward and shifts the wire pressing member 60 between two positions to be described later, and (3) a positioning plate 72 for positioning the wire pressing member 60 in rotation in a specified rotational position (first position) before the crimper 32 reaches its bottom end position, and a positioning bar 71 for positioning the wire pressing member 60 in rotation in another specified rotational position (second position) before the crimper 32 reaches its top end position.

Figure 2:
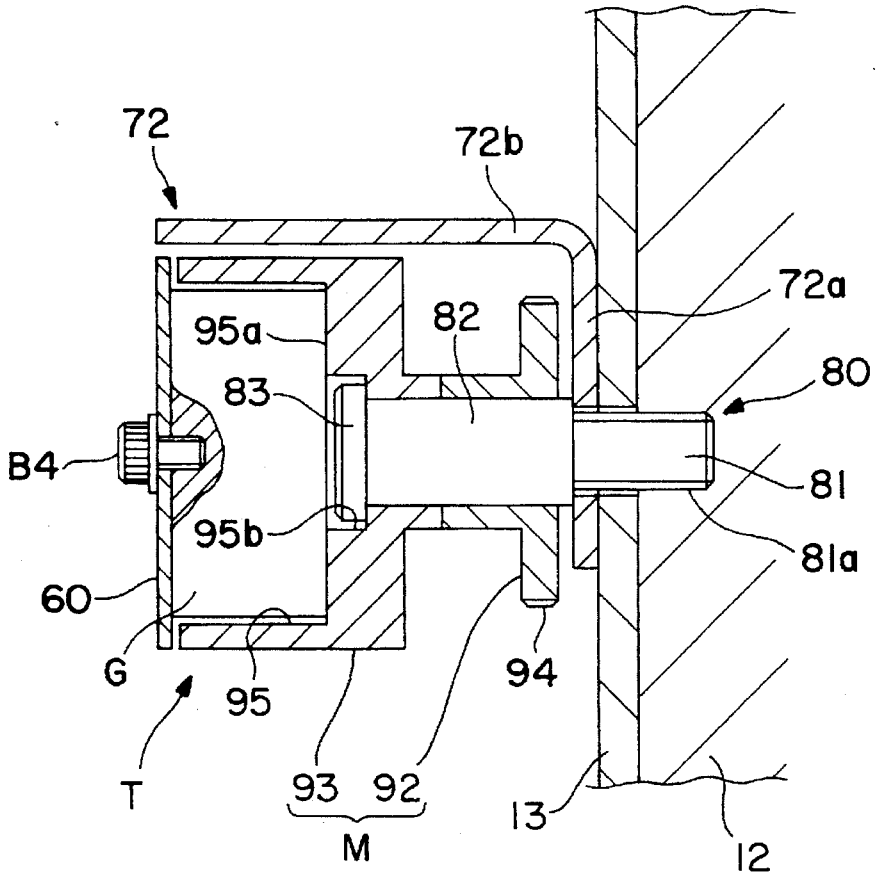
FIG. 2 is a section of an essential portion of a wire position correction device.

FIG. 2 is an enlarged vertical section of an essential portion of the gearing mechanism T including the wire pressing member 60 and the positioning plate 72.

With reference to FIGS. 1 and 2, the wire pressing member 60 is a substantially wedge-shaped plate member. One end of the wire pressing member 60 is coupled with the gearing mechanism T with a bolt B4. A pressing portion 61 for pressing the portion E1 of the wire E near its end is formed at the other distal end of the wire pressing member 60. An integrally formed contact portion 62 projects in a specified position of the one end of the wire pressing member 60. The contact portion 62 comes into contact with the positioning plate 72 when the wire pressing member 60 rotates.

The positioning bar 71 projects from one of the guide plates 13 (on the right side in FIG. 1). For example, a spring pin may be used as the positioning bar 71. When the wire pressing member 60 rotates, the other end thereof comes into contact with the positioning bar 71, with the result that the wire holding member 60 is held in the second position (position as shown in FIG. 1). The wire pressing member 60 may be held in the second position by being brought into contact with the screw B2 coupling the holding plate 33, instead with the positioning bar 71.

Figure 5:
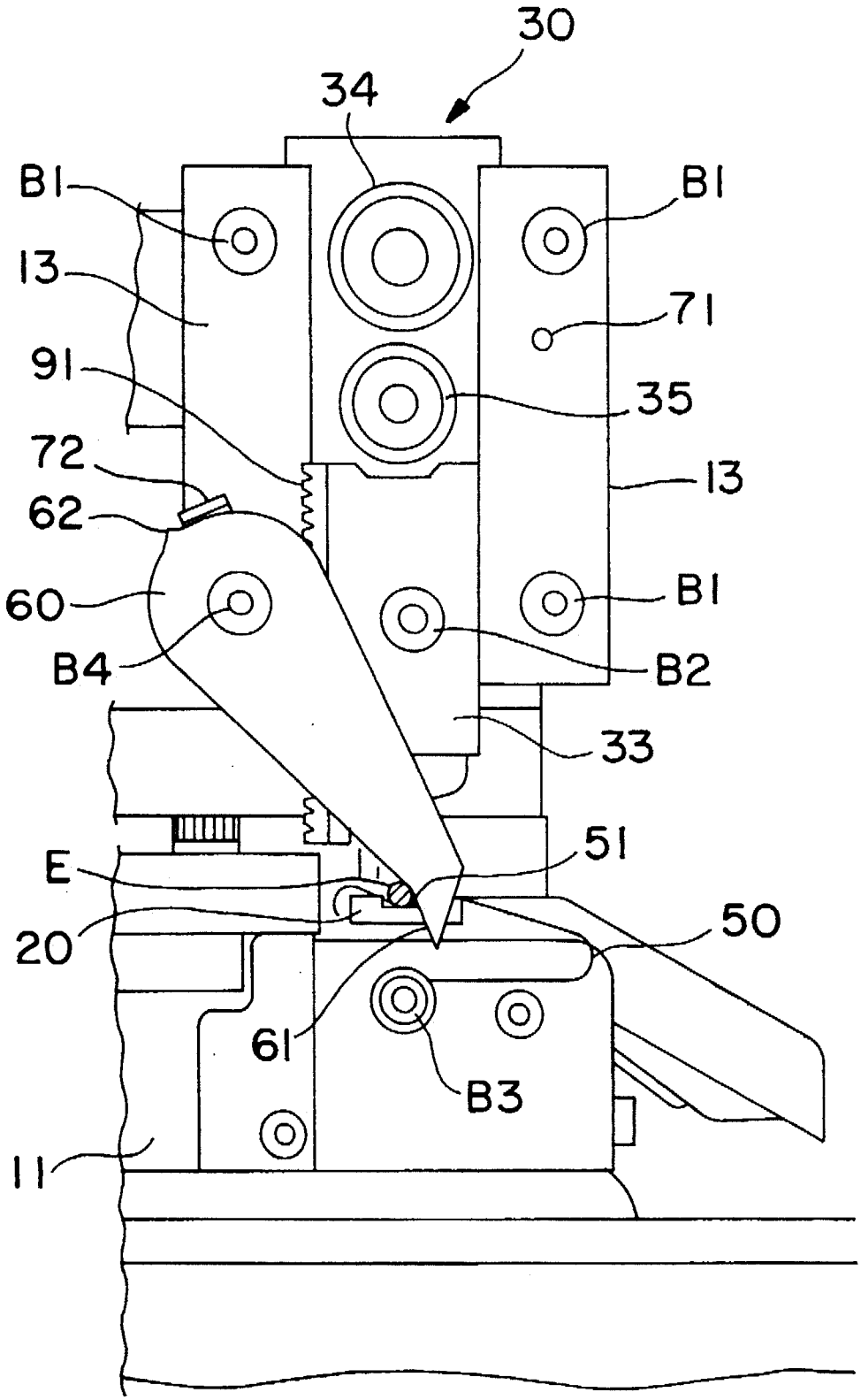
FIG. 5 is a front view showing a state in which the rotatable member (wire pressing member) is in its first position.

The positioning plate 72 is formed by bending a flat plate at a substantially right angle and includes a mount portion 72*a* and a contact portion 72*b* extending from the mount portion 72*a* at a substantially right angle. The positioning plate 72 is secured on the guide plate 13 with a shoulder bolt 80 to be described later. The contact portion 62 of the wire pressing member 60 comes into contact with the positioning plate 72 when the wire pressing member 60 rotates, with the result that the wire pressing member 60 is held in its first position (position as shown in FIG. 5). Alternatively, the wire pressing member 60 may be held in its first position by being brought into direct contact with the bed 11, instead of with the positioning plate 72, when it rotates.

The gearing mechanism T includes a movement translating mechanism for translating a linear movement of the shank 30 along the vertical direction into a rotational movement of the wire pressing member 60. Specifically, the gearing mechanism T includes the shoulder bolt 80 screwed into the guide block 12, rack teeth 91 formed at the holding plate 33, an intermediate member M supported by the shoulder bolt 80 and formed with pinion teeth 94 in mesh with the rack teeth 91, and a cylindrical magnet G mounted on the intermediate member M by means of its magnetic attraction. The wire pressing member 60 is coupled with the magnet G with a bolt B4.

The rack teeth 91 are integrally formed with the holding plate 33. The rack teeth 91 may be formed on a member different from the holding plate 33, and this member may be secured on the holding plate 33.

Figure 3:
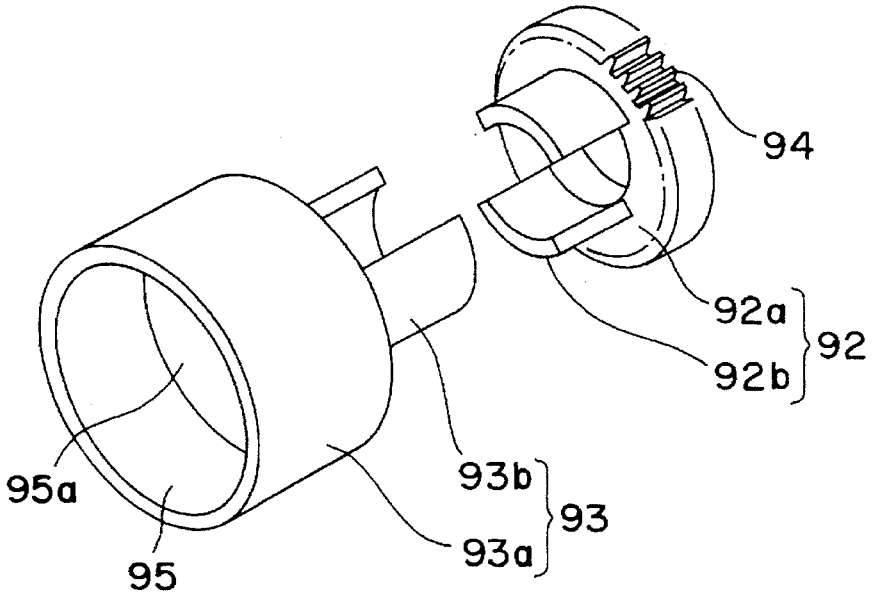
FIG. 3 is an exploded perspective view showing a coupling structure of an intermediate member.

The intermediate member M is formed of a magnetic material, and consists of two members: a first intermediate member 92 and a second intermediate member 93. FIG. 3 is an exploded perspective view showing the first and the second members 92 and 93.

With reference to FIGS. 2 and 3, the first intermediate member 92 includes a ring-like large diameter portion 92*a* and a small diameter portion 92*b* extending axially from the large diameter portion 92*a*. The pinion teeth 94 are formed at the outer circumference of the large diameter portion 92*a* along a predetermined portion or the totality thereof. The small diameter portion 92*b* is such that a pair of arcuate portions formed by cutting specified portions from a hollow cylinder along an axial direction face each other.

On the other hand, similar to the first intermediate member 92, the second intermediate member 93 includes a large diameter portion 93*a* and a small diameter portion 93*b*. Similar to the small diameter portion 92*b* of the first intermediate member 92, the small diameter portion 93*b* of the second intermediate member 93 is such that a pair of arcuate portions formed by cutting specified portions from a hollow cylinder along the axial direction face each other.

The small diameter portions 92*b* and 93*b* of the first and the second intermediate members 92 and 93 are angularly displaced with respect to each other along the axial direction and moved towards one another, whereby the projecting portions of the small diameter portions 92*b*, 93*b* engage with the cut-out portions of the small diameter portions, respectively, i.e. thereby engaging the cut-out portions of the small diameter portions 92*b* and 93*b*. In this way, the first and second intermediate members 92 and 93 are coupled such that the second intermediate member 93 rotates as the first intermediate member 92 rotates. Further, the first and the second intermediate members 92 and 93 are so coupled such that there is formed a clearance in a direction of rotation between the respective projecting portions.

The large diameter portion 93*a* of the second intermediate member 93 is formed with a circular accommodating portion 95 for accommodating the magnet G. Further, a seating portion 95*b* for seating a head 83 of the shoulder bolt 80 is formed in an inner bottom surface 95*a* of the accommodating portion 95.

The magnet G is accommodated in the accommodating portion 95 in contact with the inner bottom surface 95*a*. Such an arrangement allows the magnet G to rotate with respect to the second intermediate member 93. In other words, the intermediate member M and the wire pressing member 60 are rotatable with respect to each other. However, a frictional force acts between the magnet G and the inner bottom surface 95*a* due to the presence of the magnetic attraction of the magnet G. This frictional force restricts the rotation of the magnet G with respect to the inner bottom surface 95*a*. In other words, this frictional force restricts the rotation of the intermediate member M with respect to the wire pressing member 60.

With reference to FIG. 2, the shoulder bolt 80 includes a small diameter portion 81, a large diameter portion 82 continuous with the small diameter portion 81, and a head 83. An external thread 81*a* is formed on the small diameter portion 81. The small diameter portion 81 is screwed into the guide block 12 through the guide plate 13, thereby coupling the positioning plate 72 with the guide plate 13. The large diameter portion 82 is inserted into the first and the second intermediate members 92 and 93, with the result that the members 92 and 93 are rotatably supported on the large diameter portion 82. The head 83 of the shoulder bolt 80 is seated on the seating portion 95*b* after the shoulder bolt 80 is screwed into the guide block 12.

Next, the operation of the terminal mounting apparatus is described together with its effects.

Figure 4:
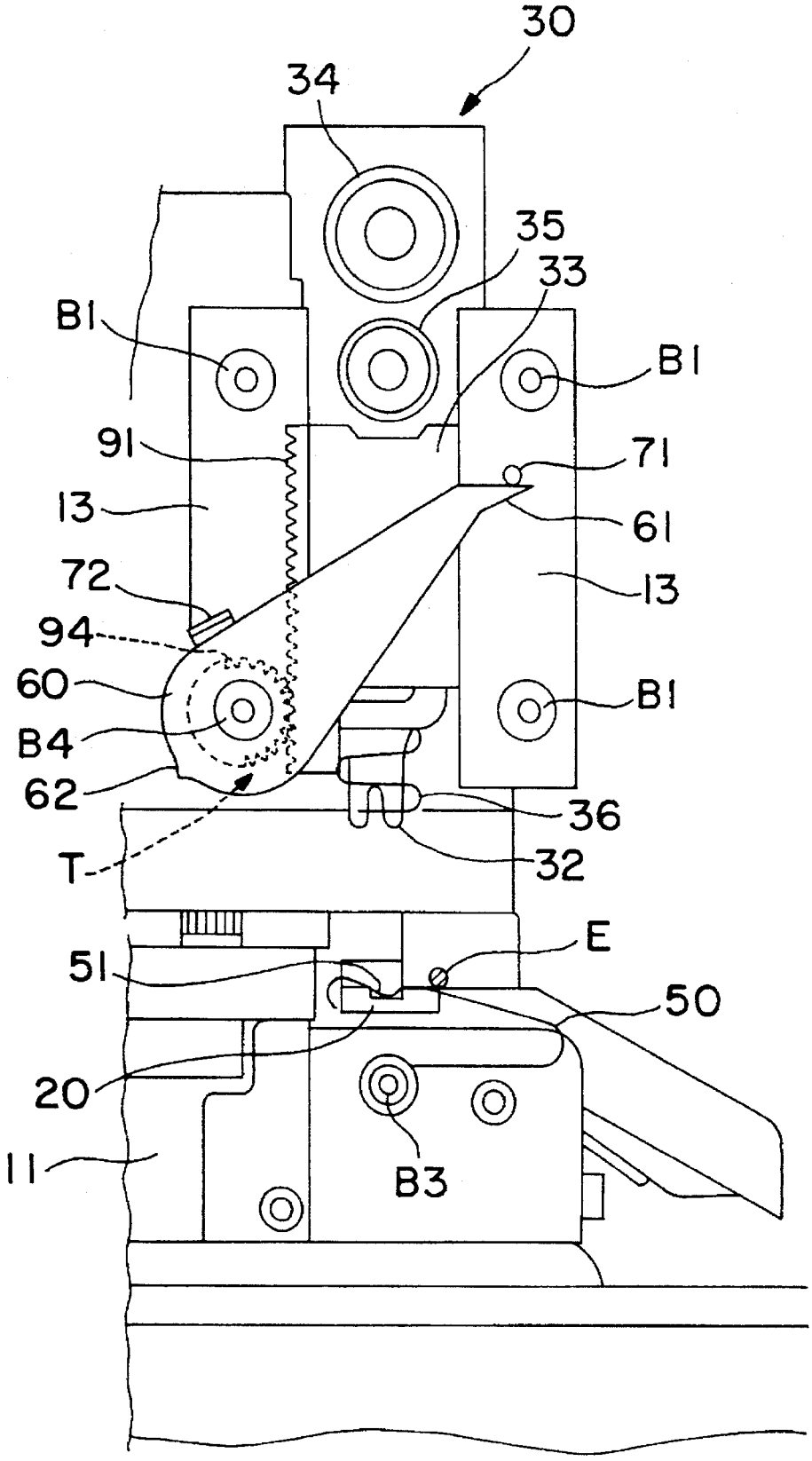
FIG. 4 is a front view showing a state in which a rotatable member (wire pressing member) is in its second position.

(1) First with reference to FIG. 1, the wire feeding arm grips the portion of the wire E away from the portion E1 near its end by the specified distance. Then, the wire feeding arm is shifted to its wire feeding position, thereby feeding the wire E to the position between the crimper 32 and the anvil 20 from the side. In this state, the shank 30 is moving upward and the wire pressing member 60 is held in its second position as shown in FIG. 4.

(2) As the wire E is fed, the crimper 32 moves downward toward the anvil 20. At this stage, as shown in FIG. 5, the wire pressing member 60 rotates as the crimper 32 moves downward, thereby being shifted from its second position to its first position. More specifically, as the wire E is fed, the shank 30 moves downward together with the press ram. This causes the crimper 32 to move down toward the anvil 20. On the other hand, since the rack teeth 91 formed at the holding plate 33 mounted on the shank 30 are in mesh with the pinion teeth 94 formed at the first intermediate member 92 (see FIG. 4), the first intermediate member 92 rotates as the crimper 32 moves downward (see FIG. 2). Thereby, the second intermediate member 93 coupled with the first intermediate member 92 rotates together with the first intermediate member 92. Together with the second intermediate member 93, the magnet G disposed therein rotates. The rotation of the magnet G causes the wire pressing member 60 coupled therewith to rotate. In this way, the wire pressing member 60 is shifted from its second position to its second position as the crimper 32 moves downward.

(3) While the position of the wire pressing member 60 is shifted, the pressing portion 61 thereof presses the portion E1 of the fed wire E near its end, thereby correcting the position of the wire E. In other words, the portion E1 of the wire E is pressed by the pressing portion 61 and is forcibly moved to the recess 51 of the wire holding member 50. Accordingly, the portion E1 of the wire E is securely held by the wire holding member 50. As a result, the end (the portion having the sheath peeled off) of the wire E is positioned on the terminal fitting fed on the anvil 20 such that the terminal fitting can be properly mounted at the end of the wire E.

Even if the portion of the wire E between the end and the position where the wire feeding arm grips the wire E should be curved or deformed while the wire E is fed by the wire feeding arm, since the portion E1 of the wire E is forcibly moved by the pressing member 60 to the recess 51 of the wire holding member 50, the end of the wire E can be constantly held in a proper position on the terminal fitting while pressing is applied. Further, the end of the wire E can be constantly held in the proper position on the terminal fitting without finely adjusting the mount position of the wire holding member 50. This avoids an erroneous mounting operation and, therefore, constantly realizes a satisfactory connection of the wire E and the terminal fitting.

(4) Particularly in this embodiment, since the linear movement of the shank 30 is translated into the rotational movement of the wire pressing member 60 by way of the rack/pinion mechanism, the gearing mechanism T advantageously has a simple construction.

(5) Further, when the wire pressing member 60 rotates from its second position, the contact portion 62 of the wire pressing member 60 comes into contact with the positioning plate 72 before the shank 30 reaches its bottom end position, i.e. before the crimper 32 reaches its bottom end position. In this way, the wire pressing member 60 is prevented from rotating any further, and is held in its first position. Accordingly, before the crimper 30 reaches its bottom end position, the portion E1 of the wire E can be securely and accurately moved into the recess 51 of the wire holding member 50 and the end of the wire E can be securely and properly positioned with respect to the terminal fitting.

While the wire pressing member 60 is held in its first position, a rotational force acts to further rotate the intermediate member M as the shank 30 moves downward. On the other hand, the rotation of the intermediate member M with respect to the magnet G is restricted by the frictional force acting due to the magnetic attraction of the magnet G. When the rotational force becomes larger than the frictional force, the intermediate member M rotates with respect to the magnet G. Thereby, the crimper 32 moves downward while the wire pressing member 60 is held in its first position, and reaches its bottom end position. As a result, the terminal fitting can be mounted at the end of the wire E while the end of the wire E is properly positioned with respect to the terminal fitting. In order to correct the position of the wire E at a specified timing before the crimper 32 reaches its bottom end position, the wire pressing member 60 is caused to rotate with respect to the intermediate member M after being brought into contact with the positioning plate 72. Thus, only a simple construction is required to correct the position of the wire E.

(6) Further, the aforementioned rotation of the intermediate member M with respect to the magnet G causes the phase of the wire pressing member 60 to be shifted with respect to the intermediate member M.

As the shank 30 moves upward after the mounting of the terminal, the wire pressing member 60 rotates. The rotating direction of the wire pressing member 60 is opposite to the direction thereof when the shank 30 moves downward. The other distal end of the wire pressing member 60 in rotation comes into contact with the positioning bar 71 before the crimper 32 reaches its top end position, and the wire pressing member 60 is held in its second position. When the other end of the wire pressing member 60 comes into contact with the positioning bar 71, a rotational force acts to further rotate the intermediate member M as the shank 30 moves upward. However, the intermediate member M rotates with respect to the magnet G for the same reason as the one described above. As a result, the shifted phase of the wire pressing member 60 with respect to the intermediate member M returns to its initial phase.

By returning the shifted phase of the wire pressing member 60 to its initial phase in this way, the wire pressing member 60 can be securely shifted to its first position when it is shifted from its second position to its first position again. Thus, the mounting operation can be continuously repeated.

(7) Further, by setting the second position of the wire pressing member 60 in a specified rotational position, an angle of rotation of the wire pressing member 60 between the first and the second position thereof can be made as small as possible, i.e. the rotational range of movement of the wire pressing member 60 between the first position and the second position can be set to be narrow. Thus, the wire pressing member 60 can be quickly rotated to press the portion E1 of the wire E while the crimper 32 moves downward, whereas it can be quickly returned to its initial position while the crimper 32 moves upward.

(8) Further, the first and the second intermediate members 92 and 93 are coupled such that they form the specified clearance in the rotation direction. In other words, the members 92 and 93 have a specified backlash, which demonstrates the following actions and effects.

A specified clearance is formed between the shank 30 and the press ram which exerts a force on the shank 30 so that the shank 30 makes a linear movement. Accordingly, when the shank 30 is pulled up by the press ram, the shank 30 moves downward by the clearance immediately after the press ram reaches the top end position. This downward movement of the shank 30 causes the first intermediate member 92 to rotate by a distance corresponding to the clearance between the shank 30 and the press ram. Accordingly, if there were not for the clearance between the first and the second intermediate members 92 and 93, the second intermediate member 93 would rotate together with the first intermediate member 92, thereby causing the wire pressing member 60 in its second position to rotate in a direction toward its first position. As a result, the wire E being fed may come into contact with the wire pressing member 60, causing a problem in feeding the wire.

Contrary to the above, in this embodiment, even if the first intermediate member 92 rotates due to the clearance between the shank 30 and the press ram, the second intermediate member 93 does not rotate together with the first intermediate member 92 because of the presence of the clearance between the members 92 and 93. Accordingly, the wire pressing member 60 does not rotate while the wire is fed. In other words, the wire can be fed without a problem.

Figure 6:
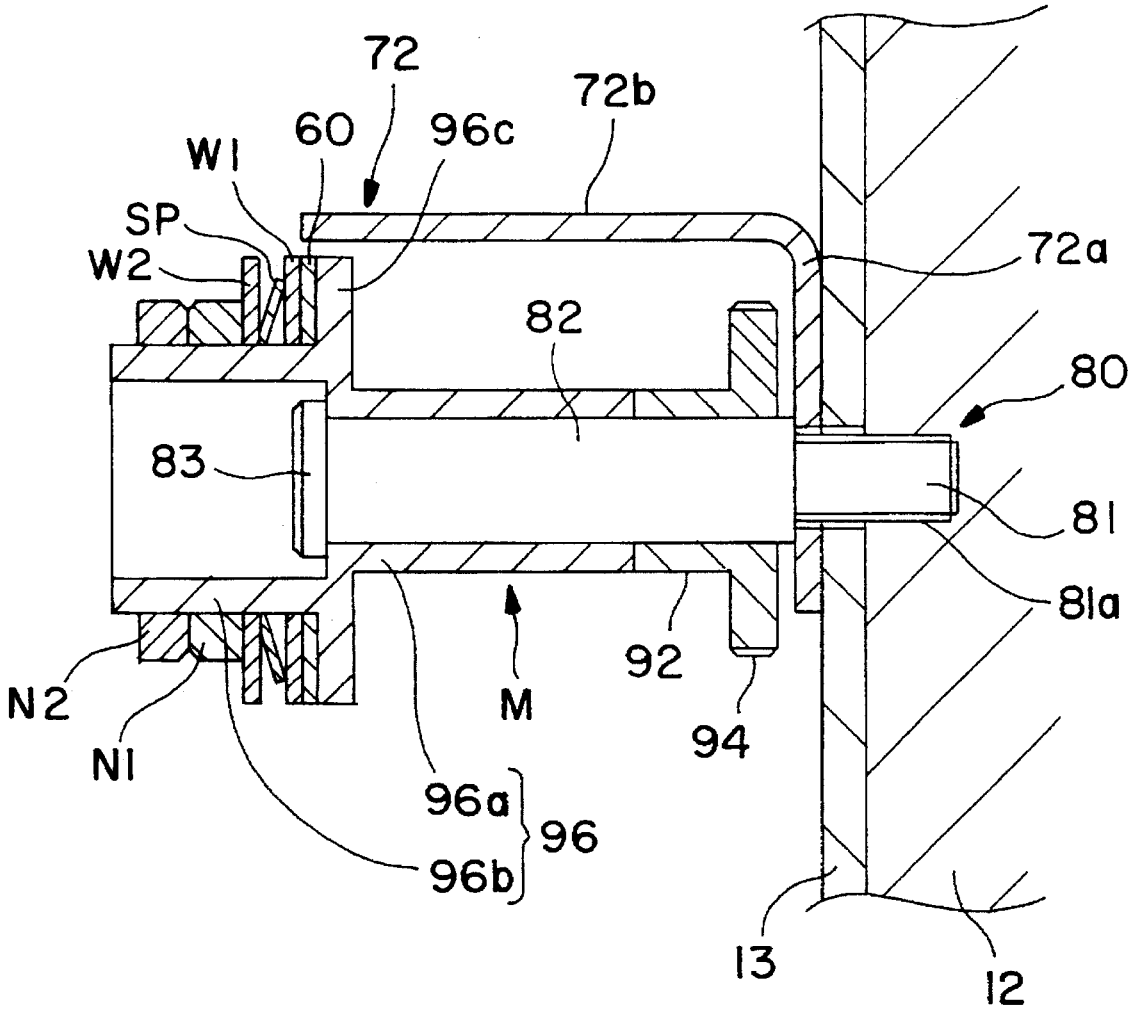
FIG. 6 is a section of an essential portion of a wire position correcting device of another embodiment.
Figure 7:
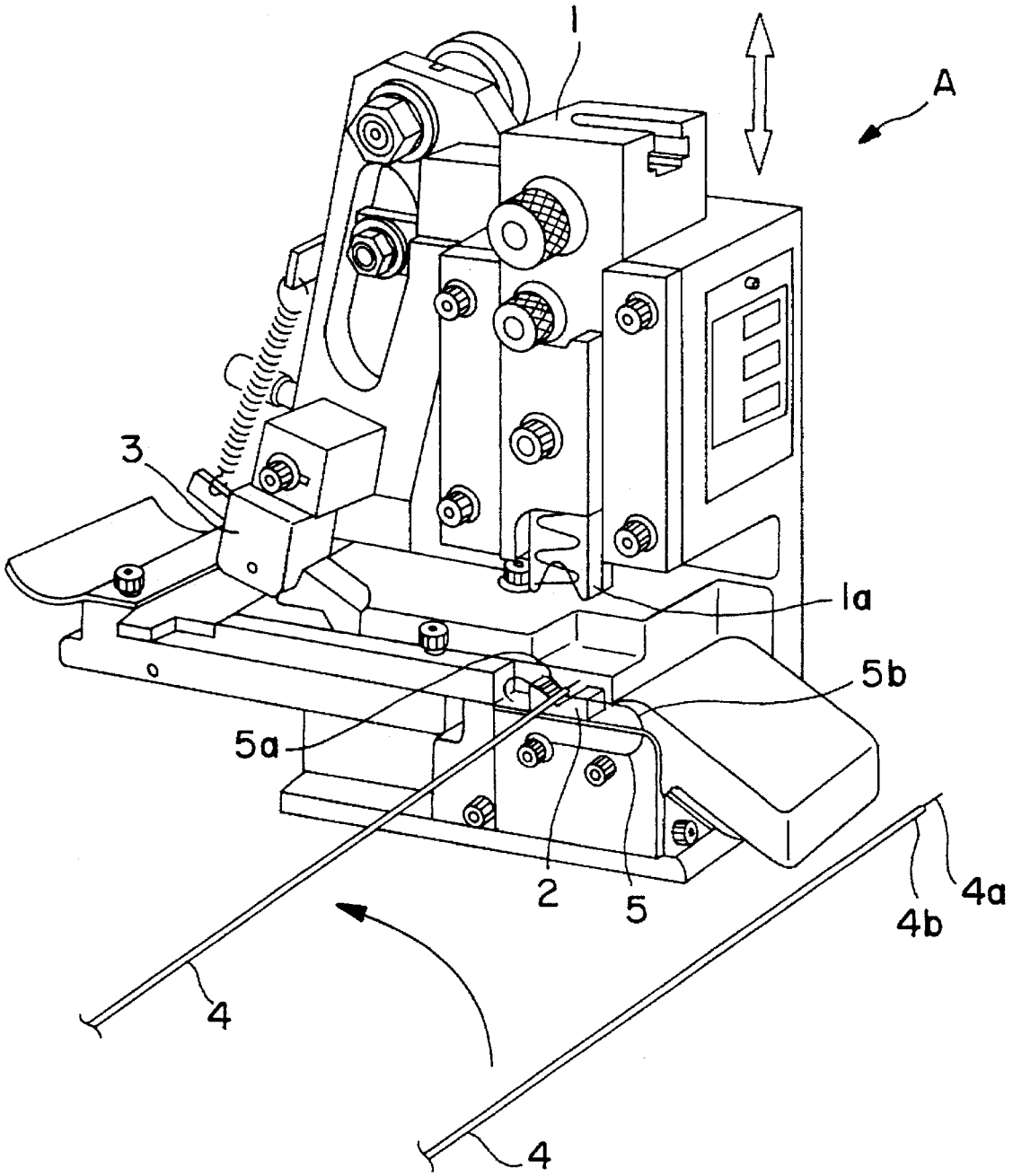
FIG. 7 PRIOR ART
FIG. 7 is a perspective view partially showing a prior art terminal mounting apparatus.

The invention is not limited to the foregoing embodiment, but may be embodied as shown in FIG. 6.

With reference to FIG. 6, this embodiment differs from the foregoing embodiment in the following point. In the foregoing embodiment, the rotation of the wire pressing member 60 with respect to the second intermediate member 93 is restricted by the frictional force which acts between the magnet G and the second intermediate member 93 due to the magnetic force of the magnet G. As opposed to the foregoing embodiment, in this embodiment, a wire pressing member 60 is pressed against a second intermediate member 96 by an elastic force of a conical spring SP, thereby producing a frictional force between the wire pressing member 60 and the second intermediate member 96. The rotation of the wire pressing member 60 with respect to the second intermediate member 96 is restricted by this frictional force.

In this embodiment, the second intermediate member 96 is a cylindrical member having a small diameter portion **96*a* and a large diameter portion 96*b*. A flange 96*c* is formed between the small and the large diameter portions 96*a* and 96*b*. An external thread is formed on the outer circumferential surface of the large diameter portion 96b. The wire pressing member 60, a washer W1, the conical spring SP and a washer W2 are mounted in this order on the large diameter portion 96b, and a nut N1 is tightened behind the washer W2. Accordingly, the wire pressing member 60 is biased toward the flange 96c by an elastic force of the conical spring SP, producing a frictional force between the wire pressing member 60 and the flange 96c. Identified by N2 is a lock nut for preventing the loosening of the nut N1. A shoulder bolt 80 is similar to the one of the foregoing embodiment, but the length of a large diameter portion 82** thereof is changed so as to conform to the construction of this embodiment. Since the other elements are similar to those of the foregoing embodiment, they are identified by like reference numerals and no description is given thereto.

This embodiment has the same operations and effects as the foregoing embodiment. Particularly, in this embodiment, when the contact portion of the wire pressing member 60 comes into contact with the positioning plate 72 or the positioning bar 71, a rotational force acts to further rotate the intermediate member M while the shank 30 makes a linear movement. However, the rotation of the wire pressing member with respect to the intermediate member M is restricted by the frictional force which is produced due to the elastic force of the conical spring SP. When the above rotational force becomes larger than the frictional force, the intermediate member M rotates with respect to the wire pressing member 60 being held positioned by the positioning bar 71 or the by the positioning plate 72. Accordingly, the portion E1 of the wire E near its end can be securely and accurately held by the wire holding member 50 before the crimper 32 reaches the bottom end position and, in this state, the terminal fitting can be properly mounted at the end of the wire.

Although the wire pressing member 60 is brought into contact with the positioning bar 71 and the positioning plate 72 to be set in its specified positions in the foregoing embodiments, a member which integrally rotates with the wire pressing member 60 may be brought into contact with the positioning bar 71 and the positioning plate 72.

Figure 8:
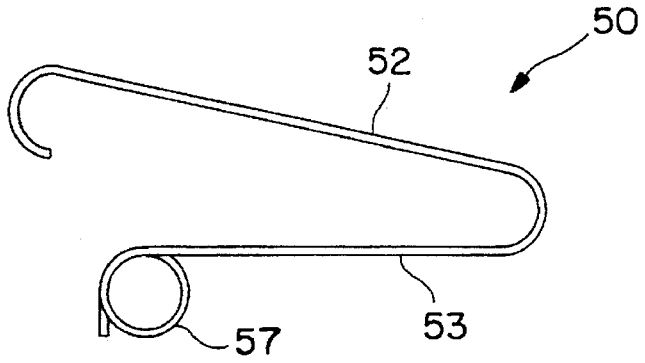
FIG. 8 is a front view of a wire support member according to a preferred embodiment of the invention.

According to a preferred embodiment, the wire support member or wire retainer or wire positioning means 50 can be formed by curving e.g. a music wire, and is mounted on the bed 11 by a bolt B3. FIG. 8 is a front view of the wire support member 50. With reference to FIG. 8, the wire support member 50 includes a mount portion 57 formed by looping a music wire, a base portion 53 horizontally extending from the mount portion 57, and a guide portion 52 extending from the base portion 53. The guide portion 52 is folded back from the base portion 53, and extends obliquely upward in a direction in which the wire E is fed by the wire feeding arm. The portion E1 of the fed wire E near its end slides upward along and in contact with the guide portion 52.

More specifically, the portion E1 near the end of the wire E is pressed by the pressing portion 61 to move toward the left in FIG. 4. Thereby, the portion E1 is guided to the guide portion 52 of the wire support member 50, and is moved upward along the guide portion 52. In other words, the position of the portion E1 with respect to the lateral direction is corrected by the wire pressing member 60, whereas the position thereof with respect to the vertical direction is corrected by the wire support member 50.

As described above, according to this embodiment, when the terminal fitting is mounted on the wire, the position of the wire E with respect to the lateral direction is corrected by being pressed by the wire pressing member 60, and the position thereof with respect to the vertical direction is corrected by being supported by the wire support member 50. Accordingly, the wire E can be accurately located along an anvil line, and the end thereof (a portion thereof where a sheath is peeled off) can be accurately positioned in the mounting position. As a result, a satisfactory terminal mounting operation can be performed.

The wire support member 50 merely supports the wire E such that the wire E moves along the guide portion 52, but does not hold the wire E. Accordingly, it is not necessary to accurately bring the mount position of the wire support member 50 into agreement with a displacement position to which the wire E is moved by the wire pressing member 60. More specifically, if the wire support member 50 would not only support, but also hold the wire E, the wire E would be bent or curved upon being held by the wire support member 50 if the held portion is not in agreement with the displacement position. In this embodiment, the wire will be neither bent nor curved. In other words, in this embodiment, the mount position of the wire support member 50 needs not be highly accurately adjusted. As a result, a satisfactory terminal mounting operation can be performed, effectively using the function of the wire support member 50.

Figure 9:
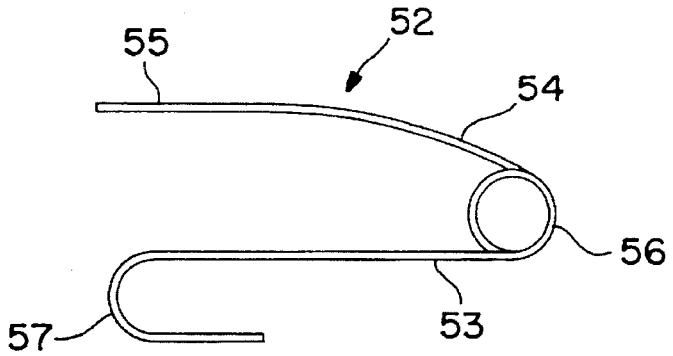
FIG. 9 is a front view of a further wire support member according to a further embodiment of the invention.

The wire support member or wire positioning means 50 may be formed as shown in FIG. 9. With reference to FIG. 9, this wire support member differs from the preceding embodiment of the wire support member 50 in that:

(1) As opposed to the mount portion 57 of the wire support member 50 formed by looping the music wire, a mount portion 57 of the modified wire support member is substantially U-shaped;

(2) Although a portion of the wire support member 50 connecting the base portion 53 and the guide portion 52 is curved, a portion 56 connecting a base portion 53 and a guide portion 52 of the modified wire support member is formed by coiling the music wire e.g. one and half times; and (3) The guide portion 52 of the modified wire support member includes a curved portion 54 formed by curving in a specified shape and a horizontal portion 55 horizontally and continuously extending from the curved portion 54. The shape of the curved portion 54 substantially conforms to a trace of movement of the wire to be fed by the wire feeding arm.

The modified wire support member has the following advantages.

(1) Since the mount portion 57 is formed substantially in U-shape, the mount position can be adjusted in the lateral direction when the wire support member is mounted on the bed 11 (see FIG. 1).

(2) Since the portion 56 connecting the base 53 and the guide portion 52 is formed by coiling the music wire one and half times, the springiness of the guide portion 52 can be improved, thereby extending a life of the wire support member.

(3) Since the curved portion 54 is formed such that its shape conforms to a trace of movement of the wire to be fed, the wire can be constantly guided in the same state as it was received by the wire support member.

In addition, the wire support member can be formed of synthetic resin rather than the music wire. In such a case, the guide portion 52 may have a flat shape.

Further, in the foregoing embodiment and modification, the rotatable wire pressing member 60 (see FIG. 1) is used to position the end of the wire being fed in the mounting position. However, another mechanism may be adopted for that purpose. For example, there may be adopted a mechanism for holding the portion near the end of the wire fed by the wire feeding arm from opposite sides of the wire to position the end of the wire in the mounting position. In this case, a pair of rotatable arms may be adopted to hold the wire. Further, the wire can be held by moving a pair of holding plates toward each other from opposite sides. A variety of other designs and modifications are also possible.

Since the wire positioning or support member merely causes the wire to move along the flat guide portion, but does, in particular not hold the wire, it is not necessary to accurately position the wire support means, in particular so as to bring the mount position thereof into agreement with the displacement position of the wire moved by the wire conveying means. Accordingly, it is not necessary to highly accurately adjust the mount position of the wire support means. Thus, a satisfactory terminal mounting operation can be performed, effectively using the function of the wire support means.

Accordingly, since the wire positioning means or wire support means is formed of a wire material, the wire support means can be fabricated at a reduced cost. As a result, the terminal mounting apparatus can be advantageously manufactured at a reduced cost.

Figure 11A:
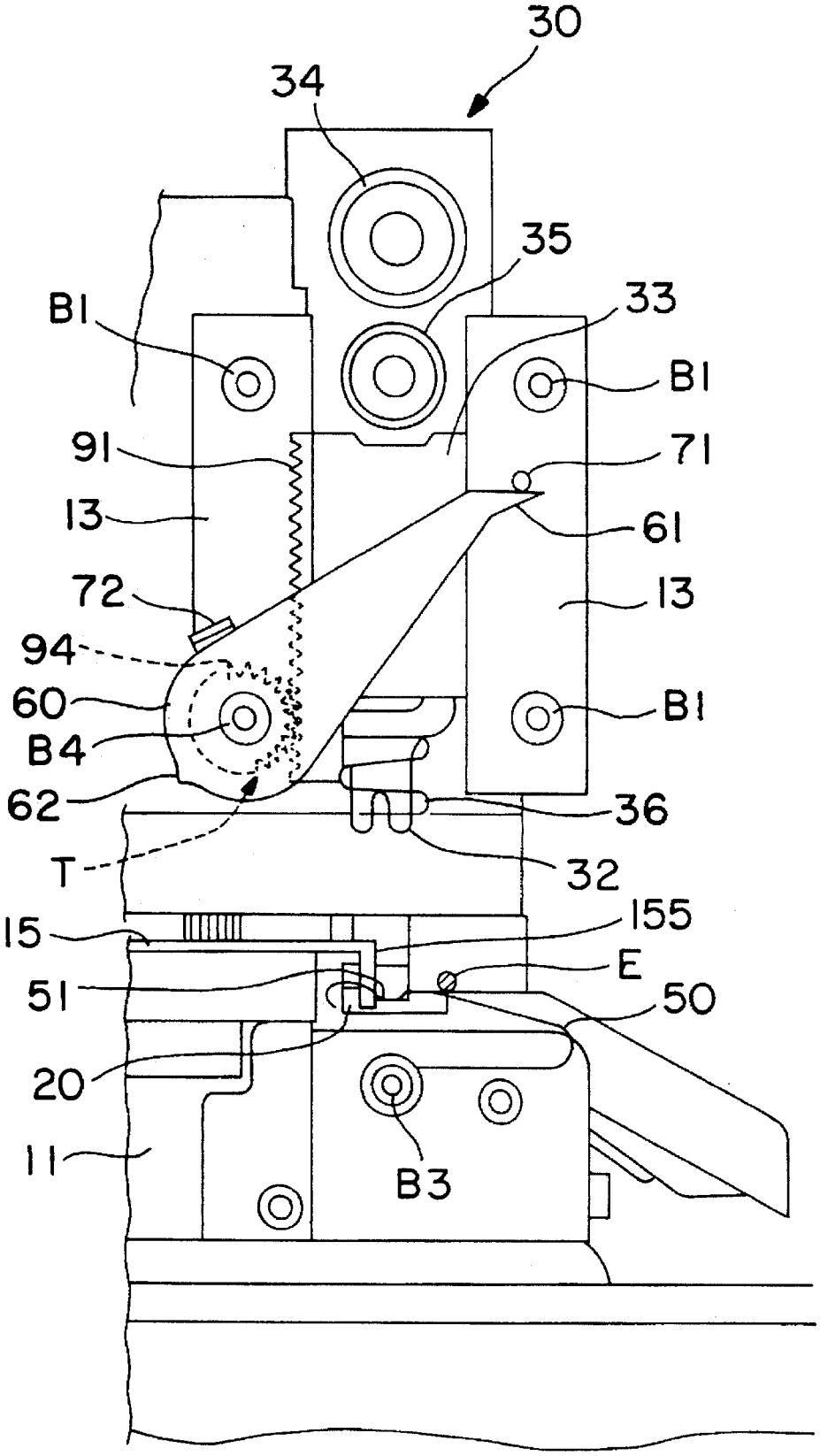
FIG. 11(A) is a front view of a wire pressing member in its second position.
Figure 11B:
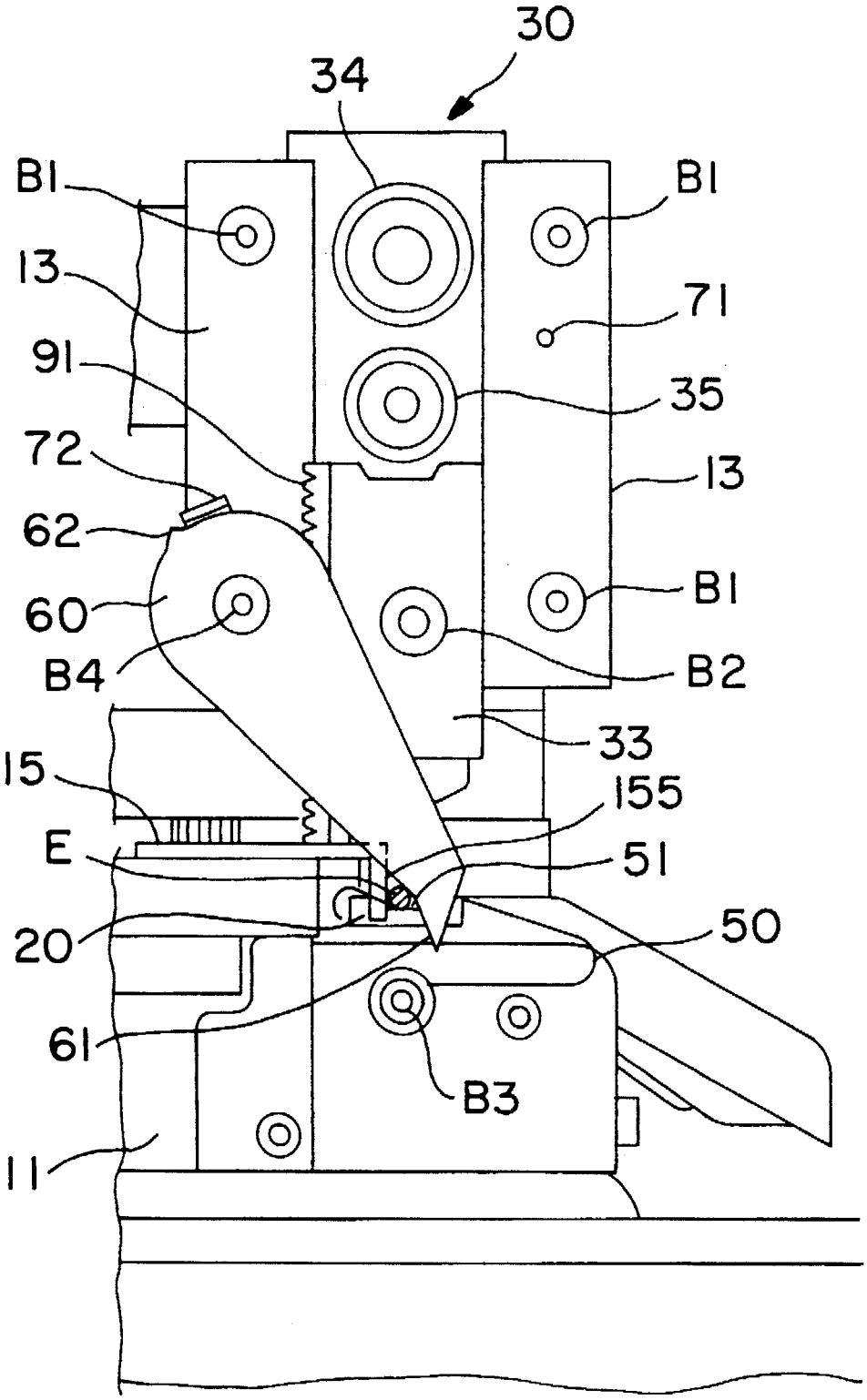
FIG. 11(B) is a front view of the wire pressing member in its first position.

According to an embodiment of the invention shown in FIG. 11, the wire processing apparatus may comprise a movement restricting member 15 restricting a movement of the fed wire E beyond a specified position in the wire feeding direction.

The wire E fed by the wire feeding arm is supported by the wire positioning means or wire support member 50. At this stage, the movement restricting member 15 restricts a movement of the wire E beyond the specified position in the wire feeding direction.

Figure 10:
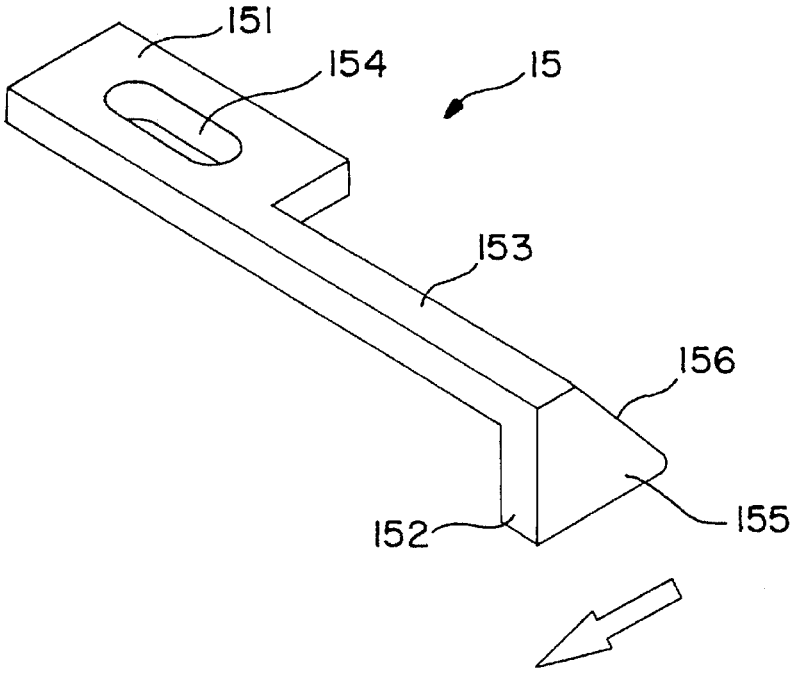
FIG. 10 is a perspective view of a movement restricting member according to a preferred embodiment of the invention.

The movement restricting member 15 is secured on a specified portion of the bed 11 by a bolt B5. FIG. 10 is a perspective view of the movement restricting member 15. With reference to FIG. 10, the movement restricting member 15 is formed of, e.g. metal, and includes a mount portion 151 to be mounted on the bed 11, a contact portion 152 for coming into contact with the wire E, and a connecting portion 153 for integrally connecting the portions 151 and 152.

The mount portion 151 has a flat shape and is formed with an oblong hole 154 extending in the horizontal direction (in a direction away from the anvil 20). The bolt B5 is inserted through the hole 154 and screwed into the bed 11. Thus, the movement restricting member 15 is secured on the bed 11 such that a distance between the member 15 and the anvil 20 is adjustable.

The contact portion 152 is formed of a flat plate which extends in the vertical direction and has such a shape that widens toward downward. An end surface of the contact portion 152 forms a restricting surface 155 which comes into contact with the wire E. The connecting portion 153 is bar-shaped and connects the mounting portion 151 and the upper end of the contact portion 152. More specifically, as shown in FIG. 1, when the movement restricting member 15 is mounted, the contact portion 152 projects toward the anvil 20 and the restricting surface 155 is located in the vicinity of the mounting position.

A specified portion of the restricting surface 155, i.e. an edge 156 which is located toward the end of the wire E when the movement restricting member 15 is mounted is formed to have a smoothly curved shape. In this embodiment, the edge 156 is formed to have a so-called R-surface i.e., the edge 156 or a transition surface between the two intersecting, in particular perpendicularly intersecting surfaces is rounded off. It should be appreciated that the edge 156 may be formed to have a so-called C-surface, i.e., the edge 156 may be canted off, chamfered, beveled or comprise one or more intermediate surfaces.

Since the wire E is fed in the lateral direction while a portion thereof away from its end by a specified distance is gripped, the portion E1 of the wire E tends to move beyond the specified position in the wire feeding direction (toward the left in FIG. 11(A)) due to an inertial force during and after the completion of conveyance of the wire E. Accordingly, the portion E1 near the end of the wire E may not suitably fit in the recess 51 of the wire support member 50. However, in this embodiment, when the wire E tries to move beyond the specified position in the wire feeding direction, the wire E comes into contact with the restricting surface 155 of the movement restricting member 15, thereby preventing the wire E from moving any further in the wire feeding direction. As a result, the portion E1 near the end of the wire E can be securely fitted in the recess 51.

According to this embodiment, when the wire E fed during an operation of mounting the terminal fitting on the wire is securely supported by the wire support member 50 without being displaced. Accordingly, the end of the wire E can be accurately positioned in the mounting position, thereby enabling a satisfactory terminal mounting operation.

Particularly, the embodiment has the following operations and effects in addition to the above.

As shown in FIG. 10, the edge 156 of the movement restricting member 15 is formed to have a R-surface. Accordingly, while the wire E is returned in a direction opposite from the wire feeding direction after the terminal fitting is mounted thereon, the mounted terminal fitting will not get caught by the restricting surface 155, particularly by the edge 156. As a result, the terminal mounting operation can be smoothly performed.

There are some kinds of terminal fittings which, after the completion of the mounting operation, may project toward the movement restricting member 15 and be bent about the edge 156. For example, if the terminal fitting is substantially L-shaped, a leading end thereof bent in L-shape may be bent about the edge 156.

In the case that the terminal fitting is substantially L-shaped, after the terminal mounting operation and before a next step, the wire E may be temporarily pulled in a direction along the restricting surface 155 (a direction indicated by a big arrow in FIG. 10) from the position where the terminal fitting is mounted thereon (while the terminal fitting remains on the anvil 20). In such a case, the mounted terminal fitting may get caught by the edge 156.

However, in this embodiment, the restricting surface 155 has such a shape that widens toward downward. In other words, the edge 156 is tilted in the direction in which the wire E is pulled (the direction of the big arrow). Thus, even if the wire E is pulled, the terminal fitting will not get caught. Specifically, since the terminal fitting moves obliquely upward along the edge 156, the terminal fitting will not get caught by the edge 156.

Figure 12A:
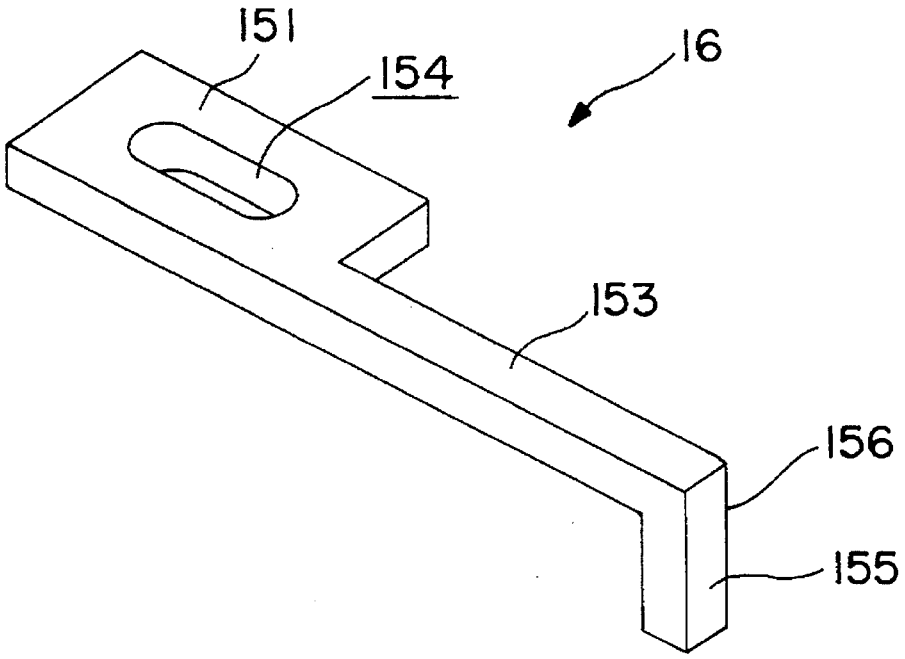
FIG. 12(A) is a perspective view of a movement restricting member according to a further preferred embodiment.

In this embodiment, the restricting surface 155 has such a shape that widens toward downward as shown in FIG. 10. This is to prevent a specially shaped terminal fitting from getting caught by the edge 156 as described above. Accordingly, when a normally shaped terminal fitting, i.e. not a substantially L-shaped terminal fitting, but a straight-shaped terminal fitting is mounted, the movement restricting member 15 may be formed as shown in FIG. 12(A). In other words, the edge 156 of the contact portion 152 of the movement restricting member 15 may be formed to extend straight downward.

Figure 12B:
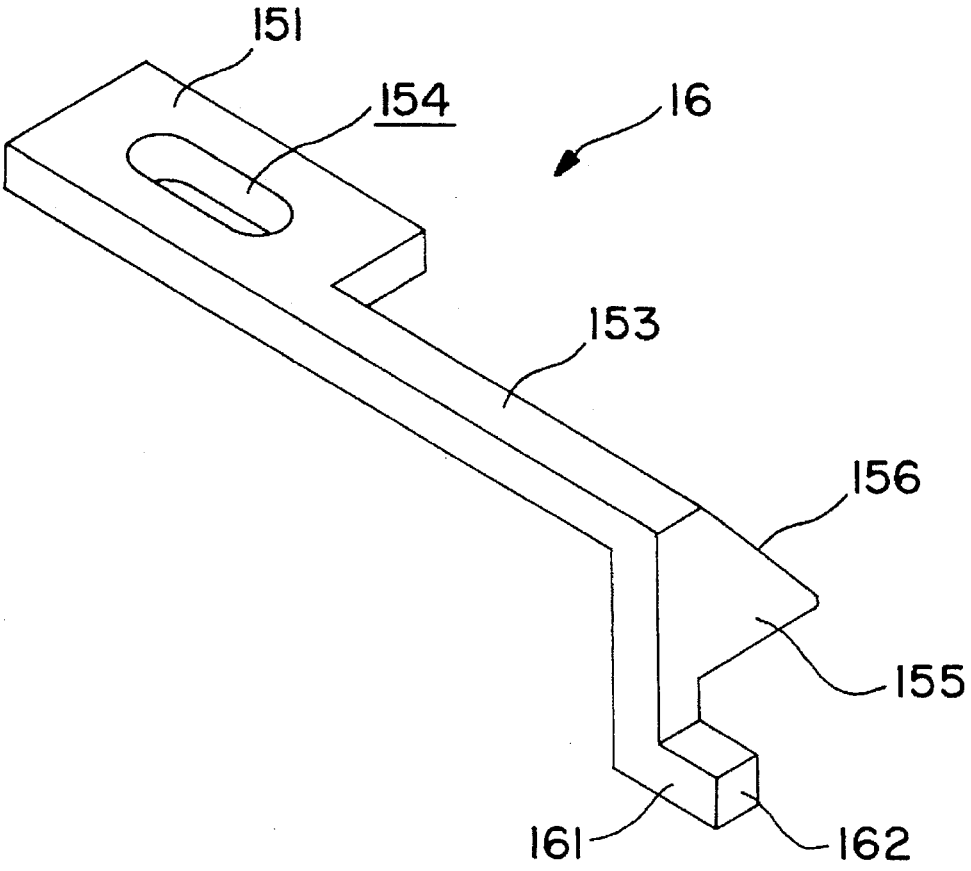
FIG. 12(B) is a perspective view of a movement restricting member according to still a further preferred embodiment.

Further, the movement restricting member may be designed as shown in FIG. 12(B). With reference to FIG. 12(B), a movement restricting member 16 differs from the movement restricting member 15 described in the foregoing embodiment in that a substantially L-shaped projection 161 is formed at the bottom of the contact portion 152. No description is given to the other elements by identifying them with the same reference numerals since the movement restricting member 15 is similar to the movement restricting member 16.

Figure 13:
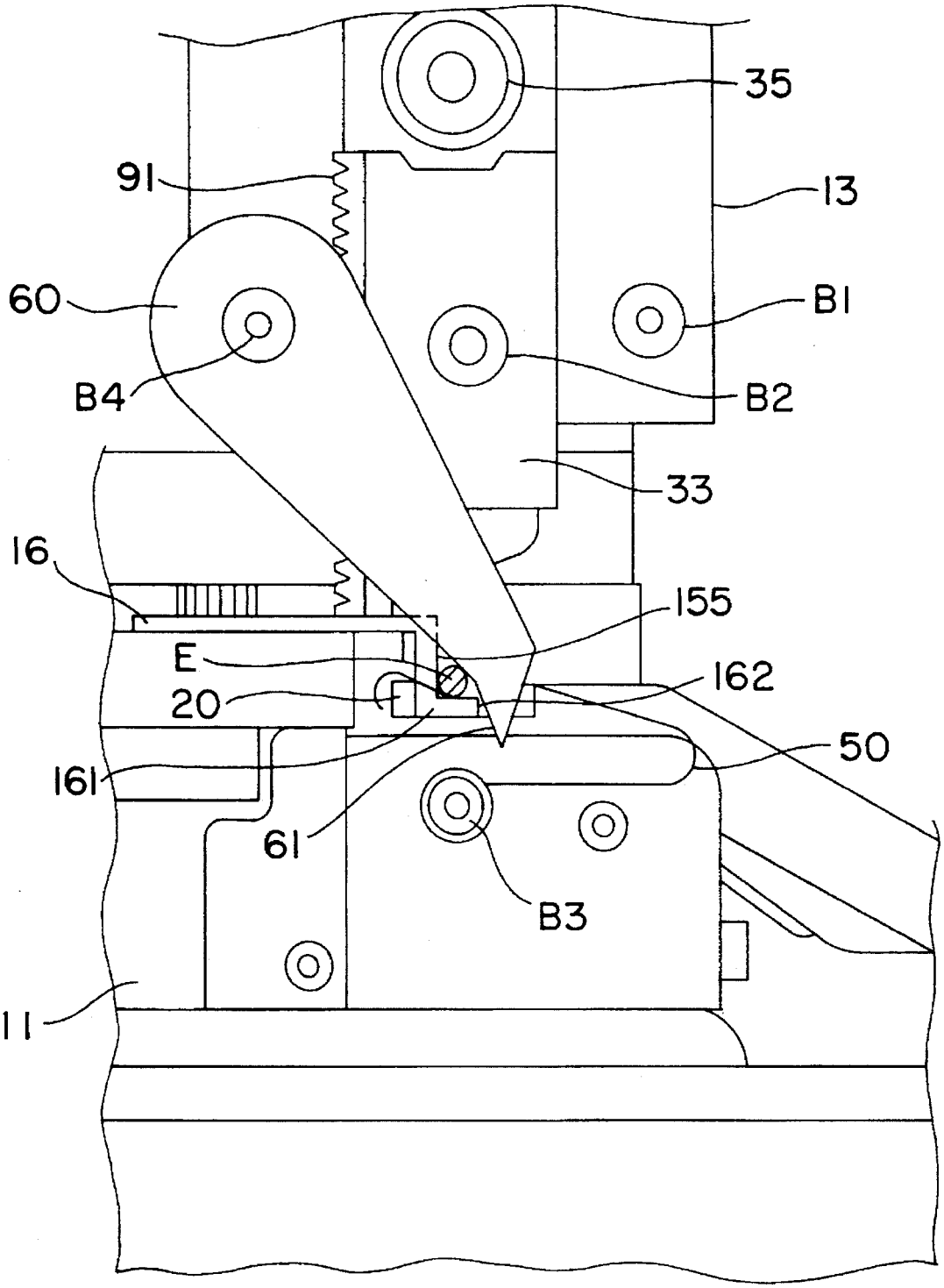
FIG. 13 is a front view showing the wire pressing member in its first position when the movement restricting member of FIG. 12(B) is mounted.

The projection 161 projects toward the anvil 20, i.e. in the direction opposite from the wire feeding direction by a specified distance. A leading end face 162 of the projection 161 comes into contact with the wire position correcting means or wire pressing member 60. The projection 161 is described in more detail with reference to FIG. 13. When the wire pressing member 60 rotates toward its second position, the leading end face 162 of the projection 161 comes into contact with the leading end of the pressing portion 61, with the result that the wire pressing member 60 is positioned in its first position. At this stage, the wire E is located between the pressing portion 61 and the restricting surface 155, the pressing portion 61 and the restricting surface 155 approach the wire E from the right and left, respectively, with the result that the wire E is positioned. Further, since a specified clearance is formed between the pressing portion 61 and the restricting surface 155 upon contact of the wire pressing member 60 with the projection 161, a problem that the wire E is damaged by being strongly held can be avoided.

The movement restricting member 16 acts as a means for restricting a movement of the wire E and a means for positioning the wire pressing member 60. Accordingly, by adopting the movement restricting member 16, the positioning plate 72 described in the foregoing embodiment can be dispensed with, and the wire pressing member 60 need not have the contact portion 62 (see FIG. 1). This advantageously leads to a reduced number of parts and a simplified construction. Further, when the wire pressing member 60 is to be positioned in its first position by the projection 161, the leading end of the pressing portion 61 of the wire pressing member 60 comes into contact with the leading end face 162 of the projection 161. Thus, the wire pressing member 60 can be accurately positioned in its first position.

With this modification as well, the shape of the contact portion 152 of the movement restricting member 15 may be changed as shown in FIG. 12(A) depending upon the kind of the terminal fitting.

In the foregoing embodiment and modifications, in order to position the wire pressing member 60, the positioning bar 71 and the positioning plate 72 are directly brought into contact with the wire pressing member 60. The positioning bar 71 and the positioning plate 72 may be brought into contact with a member integrally rotatable with the wire pressing member 60. Further, the wire support member 50 may be formed of a material other than a music wire.

Accordingly, the wire is fed between the upper and lower molds when the wire feeding means holding the portion of the wire away from the end thereof by a specified distance shifts to its wire feeding position. Thereby, the portion of the wire near its end is supported by the wire supporting means and is positioned in the mounting position. At this stage, even if the wire unstably held by the wire feeding means tries to move beyond the specified position in the wire feeding direction, it comes into contact with the restricting surface of the movement restricting means, preventing the wire from being displaced. Thus, the portion of the wire near its end can be accurately positioned in the mounting position. As a result, a satisfactory terminal mounting operation can be performed.

In addition, since the restricting surface may be so formed as to have a smoothly curved shape, when the wire is moved in the direction opposite from the wire feeding direction after the terminal fitting is mounted on the wire, the mounted terminal will not get caught. Thus, the terminal mounting operation can be smoothly performed.

Furthermore, even if the wire is pulled along the restricting surface of the movement restricting means, since the restricting surface may have such a shape that widens downwardly, the terminal fitting will not get caught by the movement restricting means. Accordingly, the terminal fitting moves obliquely upward along a tilted portion of the movement restricting means. As a result, the terminal mounting operation can be more smoothly performed.

Furthermore, since the movement restricting means may also act as the first positioning means, the number of parts can be reduced and the construction can be simplified. As a result, the terminal mounting apparatus can be manufactured at a reduced cost.

What is claimed is:

1. A wire processing apparatus (A) for mounting a terminal on an end portion (E1) of a wire (E) comprising:

an anvil (20), a crimper (32) movable upward and downward with respect to the anvil (20), wire feeding means for conveying the end portion (E1) of the wire (E) between the crimper (32) and the anvil (20), wire receiving means (50) adjacent the anvil (20) for receiving the end portion (E1) of the wire (E) conveyed by the wire feeding means, wire position correcting means (60) which is movable relative to the wire receiving means (50) for guiding the end portion (E1) of the wire (E) along the wire receiving means (50) and into a selected correct position relative to the wire receiving means (50) and the anvil (20), a gearing mechanism (T) connected to the crimper (32) and the wire position correcting means (60) for translating a portion of the movement of the crimper 32 into the movement of the wire position correcting means (60), whereby the wire receiving means (50) and the wire position correcting means (60) position the end portion (E1) of the wire (E) in the selected correct position for crimping the terminal to the end portion (E1) of the wire (E).

2. The apparatus according to claim 1, wherein the wire positioning means (50) comprises a segment of wire formed with a guide portion (52) extending obliquely upward for guiding a portion of the wire (E).

3. A wire processing apparatus (A) for mounting a terminal on an end portion (E1) of a wire (E) comprising:

an anvil (20), wire feeding means for conveying the end portion (E1) of the wire (E) into proximity to the anvil (20), wire receiving means (50) adjacent the anvil (20) for receiving the end portion (E1) of the wire (E) conveyed by the wire feeding means, a crimper (32) movable relative to the anvil (20) for crimping the terminal to the end portion (E1) of the wire (E), and a wire position correction means which comprises a rotatable member (60) having one end rotatably supported on a main body (10) and another end formed with a guiding portion (61) for guiding the end portion (E1) of the wire (E) along the wire receiving means (50) and into a selected correct position relative to the anvil (20), and a gearing mechanism (T) connected to the rotatable member (60) and the crimper (32) for rotating the rotatable member (60) in response to a portion of the movement of the crimper (32).

4. The apparatus according to claim 3, wherein the gearing mechanism (T) comprises a movement translating mechanism (91, 94) for converting a linear movement of the crimper (32) into a rotational movement of the rotatable member (60).

5. The apparatus according to claim 3, further comprising:

first positioning means (72; 16) provided for coming into contact with the wire position correcting means (60) at a specified timing before the crimper (32) completes its movement, thereby holding the wire position correcting means (60) in a second position, and second positioning means (71) provided for coming into contact with the wire position correcting means (60) at another specified timing, before the crimper (32) completes its upward movement, thereby holding the wire position correcting means (60) in a first position.

6. The apparatus according to claim 3, wherein the gearing mechanism (T) comprises an intermediate member (M) interposed between the upper means (10) and the rotatable member (60).

7. The apparatus according to claim 6, wherein the rotatable member (60) is coupled with the intermediate member (M) by means of constraining means (G; SP) for temporarily rotating the rotatable member (60) integrally with the intermediate member (M).

8. The apparatus according to claim 7, wherein the constraining means (G; SP) comprises frictional resistance applying means for applying a frictional resistance between the rotatable member (60) and the intermediate member (M).

9. The apparatus according to claim 8, wherein the intermediate member (M) is coupled with the crimper (32) with a specified backlash.

10. The apparatus according to claim 9, wherein the intermediate member (M) comprises first (92) and second (93) intermediate member parts arranged such that they form a clearance therebetween in an interaction direction for providing the specified backlash.

11. The apparatus according to claim 3, further comprising movement restricting means (15; 16) for restricting a movement of the wire (E) beyond a specified position in a wire feeding direction.

12. The apparatus according to claim 11, wherein the movement restricting means (15; 16) is formed with a restricting surface (155) which comes into contact with the wire (E) being fed by the wire feeding means.

13. The apparatus according to claim 12, wherein the restricting surface (155) is formed with an edge (156) facing toward the end of the wire being fed, said edge having a smoothly curved shape.

14. The apparatus according to claim 13, wherein the restricting surface (155) has a downwardly widening shape.

15. The apparatus according to claim 14, wherein the movement restricting means (16) is engageable with the wire position correcting means (60) to limit the movement of the wire position correcting means (60), whereby the crimper (32) may move while the wire position correcting means (60) is held in a fixed position.

* * * * *

UNITED STATES PATENT AND TRADEMARK OFFICE

CERTIFICATE OF CORRECTION

PATENT NO. : 5,661,898

DATED : September 2, 1997

INVENTOR(S) : Susumu Matsuzawa

It is certified that error appears in the above-identified patent and that said Letters Patent are hereby corrected as shown below:

On the title page, item [54]
Correct the title of the invention to read --TERMINAL CRIMPING APPARATUS WITH WIRE POSITION CORRECTING DEVICE--.

Signed and Sealed this

Twenty-fifth Day of November, 1997

*Attest:*

*Attesting Officer*

BRUCE LEHMAN

*Commissioner of Patents and Trademarks*